US009205654B2

(12) United States Patent
Uyama

(10) Patent No.: US 9,205,654 B2
(45) Date of Patent: Dec. 8, 2015

(54) METHOD OF MANUFACTURING A LIQUID EJECTION HEAD

(71) Applicant: CANON KABUSHIKI KAISHA, Tokyo (JP)

(72) Inventor: Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/287,843

(22) Filed: May 27, 2014

(65) Prior Publication Data

US 2014/0360978 A1 Dec. 11, 2014

(30) Foreign Application Priority Data

Jun. 6, 2013 (JP) ..... 2013-119820

(51) Int. Cl.
*B41J 2/16* (2006.01)

(52) U.S. Cl.
CPC ..... *B41J 2/1628* (2013.01); *B41J 2/1603* (2013.01); *B41J 2/1606* (2013.01); *B41J 2/1629* (2013.01); *B41J 2/1631* (2013.01); *B41J 2/1639* (2013.01); *B41J 2/1642* (2013.01); *B41J 2/1645* (2013.01); *B41J 2/1646* (2013.01)

(58) Field of Classification Search
None
See application file for complete search history.

(56) References Cited

U.S. PATENT DOCUMENTS

| | | | | |
|---|---|---|---|---|
| 4,694,308 | A | 9/1987 | Chan et al. | |
| 4,716,423 | A | 12/1987 | Chan et al. | |
| 5,478,606 | A | 12/1995 | Ohkuma et al. | |
| 6,390,606 | B1 * | 5/2002 | Terui et al. | 347/63 |
| 6,627,467 | B2 * | 9/2003 | Haluzak et al. | 438/21 |
| 7,293,359 | B2 * | 11/2007 | Shaarawi et al. | 29/890.1 |
| 2005/0130075 | A1 | 6/2005 | Shaarawi et al. | |
| 2006/0152550 | A1 * | 7/2006 | Tomita et al. | 347/47 |
| 2007/0020794 | A1 * | 1/2007 | DeBar | 438/50 |
| 2009/0040266 | A1 * | 2/2009 | Terui et al. | 347/29 |
| 2009/0212008 | A1 * | 8/2009 | Uyama et al. | 216/27 |
| 2012/0113200 | A1 * | 5/2012 | Uyama | 347/102 |
| 2012/0120158 | A1 * | 5/2012 | Sakai et al. | 347/65 |
| 2012/0242747 | A1 * | 9/2012 | Kurosu et al. | 347/44 |
| 2013/0029437 | A1 * | 1/2013 | Uyama | 438/21 |
| 2014/0093646 | A1 * | 4/2014 | Uyama | 427/299 |
| 2014/0132672 | A1 * | 5/2014 | Goto et al. | 347/44 |

FOREIGN PATENT DOCUMENTS

| | | | |
|---|---|---|---|
| JP | 7-29437 | B2 | 4/1995 |
| JP | 3143307 | B2 | 3/2001 |
| JP | 4498363 | B2 | 7/2010 |

* cited by examiner

*Primary Examiner* — Allan Olsen

(74) *Attorney, Agent, or Firm* — Fitzpatrick, Cella, Harper & Scinto

(57) ABSTRACT

Provided is a method of manufacturing a liquid ejection head including: a substrate having energy generating elements disposed thereon; and an ejection orifice forming member having ejection orifices, the substrate and the ejection orifice forming member forming a flow path therebetween, the method including: forming, on the substrate, a mold having a recessed portion at a position corresponding to a region in which each of the ejection orifices is formed and in a vicinity of the position; forming a coating layer by chemical vapor deposition so as to cover the mold; and forming the ejection orifices through the coating layer to obtain the ejection orifice forming member.

8 Claims, 4 Drawing Sheets

METHOD OF MANUFACTURING A LIQUID EJECTION HEAD

BACKGROUND OF THE INVENTION

1. Field of the Invention

The present invention relates to a method of manufacturing a liquid ejection head.

2. Description of the Related Art

There has been proposed a liquid ejection head having such a shape that an ejection orifice forming member is recessed with respect to the surface of the ejection orifice forming member in the vicinity of an ejection orifice (Japanese Patent Publication No. H07-29437 and Japanese Patent No. 4498363). Such a shape can reduce damage caused by rubbing of liquid adhering to the surface of the head or damage on the ejection orifice caused by collision of paper to the head due to a paper conveyance error, and hence the liquid ejection head having the above-mentioned shape has a longer life. On the other hand, in Japanese Patent No. 3143307, there is disclosed a method of manufacturing a liquid ejection head, including forming a mold in a part to be formed into a flow path of liquid, applying a liquid resin material so as to cover the mold by spin coating to form the ejection orifice forming member, and removing the mold.

The ejection orifice forming member of the liquid ejection head has multiple ejection orifices formed therein, and liquid droplets are caused to fly from the ejection orifices to obtain a printed matter. The thickness of the ejection orifice forming member affects the volume and flying speed of the liquid droplets that are caused to fly from the ejection orifices. Therefore, when fluctuations in thickness of the ejection orifice forming member are large, the quality of the printed matter reduces. Therefore, it is preferred that the fluctuations in thickness of the ejection orifice forming member be small. On the other hand, as the method of manufacturing a liquid ejection head having such a shape that the ejection orifice forming member is recessed with respect to the surface of the ejection orifice forming member in the vicinity of the ejection orifice, there are known a method involving using electroforming (Japanese Patent Publication No. H07-29437), a method involving subjecting a photosensitive resin to weak exposure and heat treatment in combination (Japanese Patent No. 4498363), or the like.

However, the ejection orifice forming member formed by those methods has large fluctuations in thickness of the ejection orifice forming member, which affects the printing quality. In the method disclosed in Japanese Patent Publication No. H07-29437, when electroforming is carried out, a difference is easily generated in applied current amount between the center and the outer periphery of the substrate, and hence the metal film to be formed is liable to have different thicknesses. Further, in the method disclosed in Japanese Patent No. 4498363, during a time period from exposure via heat treatment to development for forming the recessed portion, the acid diffusion degree is liable to vary in the exposed region, and hence the depth of the recess is liable to fluctuate. Further, it is also conceivable to apply a method disclosed in Japanese Patent No. 3143307 to employ a method involving forming a recessed portion in the mold in advance, and then forming the ejection orifice forming member by spin coating. However, the ejection orifice forming member is made of a liquid resin, which may absorb the step or the recessed portion. Therefore, it is difficult to form the recessed portion in the surface of the ejection orifice forming member. Further, it is difficult to reduce the fluctuations in thickness of the ejection orifice forming member.

SUMMARY OF INVENTION

According to one aspect of the present invention, there is provided a method of manufacturing a liquid ejection head including a substrate having energy generating elements disposed thereon; and an ejection orifice forming member having ejection orifices, the substrate and the ejection orifice forming member forming a flow path therebetween, the method including: forming, on the substrate, a mold having a recessed portion at a position corresponding to a region in which each of the ejection orifices is formed and in vicinity of the position; forming a coating layer by chemical vapor deposition so as to cover the mold; and forming the ejection orifices through the coating layer to obtain the ejection orifice forming member.

Further features of the present invention will become apparent from description of exemplary embodiments with reference to the attached drawings.

DESCRIPTION OF THE EMBODIMENTS

Preferred embodiments of the present invention will now be described in detail in accordance with the accompanying drawings.

When a liquid ejection head is manufactured to have such a shape that an ejection orifice forming member is recessed with respect to the surface of the ejection orifice forming member in the vicinity of ejection orifice, it is difficult to reduce fluctuations in thickness of the ejection orifice forming member. Therefore, the obtained liquid ejection head cannot eject liquid from each ejection orifice in a stable amount and flying speed. The present invention has an object to provide a liquid ejection head capable of ejecting liquid from each ejection orifice in a stable amount and flying speed.

A method of manufacturing a liquid ejection head according to the present invention includes: a substrate having energy generating elements disposed thereon; and an ejection orifice forming member having ejection orifices, the substrate and the ejection orifice forming member forming a flow path therebetween, the method including: forming, on the substrate, a mold having a recessed portion at a position corresponding to a region in which each of the ejection orifices is formed and in a vicinity of the position; forming a coating layer by chemical vapor deposition as to cover the mold; and forming the ejection orifices through the coating layer to obtain the ejection orifice forming member.

According to the method of the present invention, when the liquid ejection head is manufactured to have such a shape that the surface of the ejection orifice forming member is recessed in the vicinity of the ejection orifice, chemical vapor deposition (hereinafter referred to as "CVD") is employed to form the coating layer to be formed into the ejection orifice forming member. With this, the coating layer is formed in a substantially conformal manner even on the recessed portion of the mold. Therefore, fluctuations in thickness of the ejection orifice forming member are reduced, and it is possible to obtain the liquid ejection head capable of ejecting liquid from each ejection orifice in a stable amount and flying speed. When the liquid ejection head is used as an ink jet recording head, a satisfactory printing quality can be exhibited. In the following, with reference to the drawings, embodiments of the present invention are described. Note that, the present invention is not limited to those embodiments.

Figure 2:
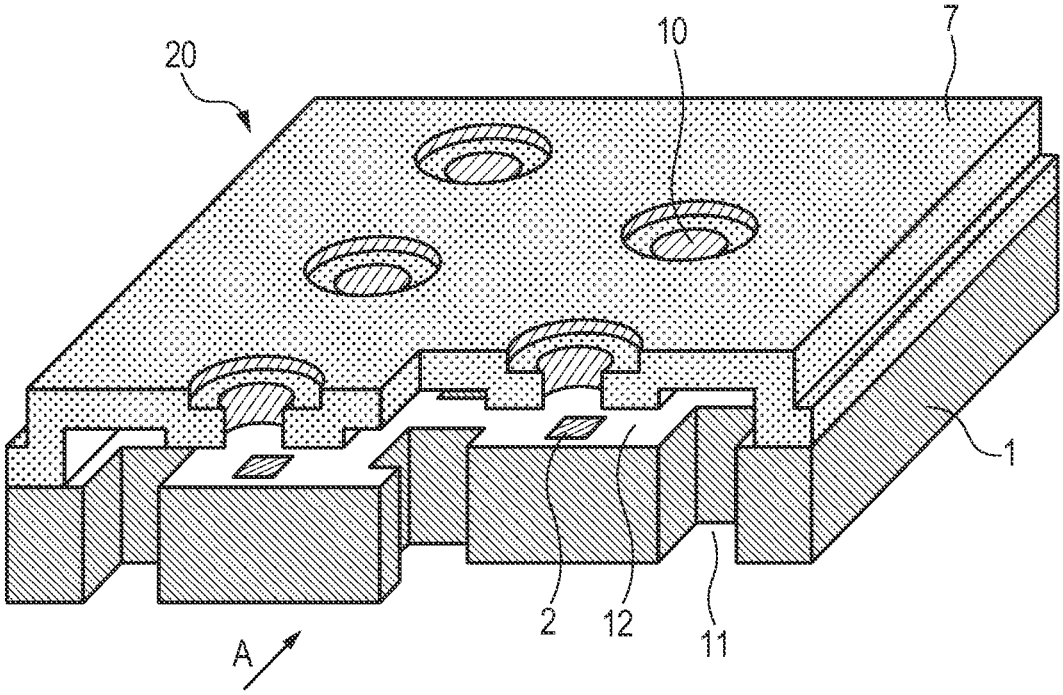
FIG. 2 is a perspective sectional view illustrating an example of a liquid ejection head manufactured by the method according to the present invention.

FIG. 2 illustrates an example of a liquid ejection head to be manufactured by a method according to the present invention. A liquid ejection head 20 illustrated in FIG. 2 includes a substrate 1 having multiple energy generating elements 2 disposed thereon in two rows. An ejection orifice forming member 7 is formed on the substrate 1 so as to form a flow path 12 together with the substrate 1. The ejection orifice forming member has ejection orifices 10 formed at positions corresponding to the energy generating elements 2. The surface of the ejection orifice forming member 7 is recessed in the vicinity of the ejection orifices 10. Further, the substrate has a supply port 11 formed therein so as to pass through the substrate 1. Liquid that has been supplied through the supply port 11 to the flow path 12 is ejected from the ejection orifice 10 by energy generated by the energy generating element 2.

In the following, with reference to FIGS. 1A to 1H, an example of a method of manufacturing a liquid ejection head according to the present invention is described. FIGS. 1A to 1H are sectional views as viewed from an A direction of FIG. 2, which illustrate the example of the method of manufacturing a liquid ejection head according to the present invention.

Figure 1A:
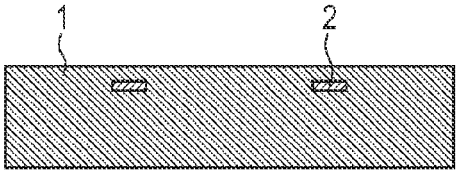
FIGS. 1A, 1B, 1C, 1D, 1E, 1F, 1G and 1H are sectional views illustrating an example of a method of manufacturing a liquid ejection head according to the present invention.

First, as illustrated in FIG. 1A, the substrate 1 having the multiple energy generating elements 2 disposed thereon is prepared. It is preferred that the substrate 1 be a monocrystalline silicon substrate so that a drive circuit or wiring that connects together the drive circuit and the energy generating element 2 can be easily formed thereon. As the energy generating element 2, any element can be used as long as the element can convert electricity into foaming energy. For example, the energy generating element 2 may be a heater type energy generating element that generates heat by conducting electricity through a resistor.

Figure 1B:
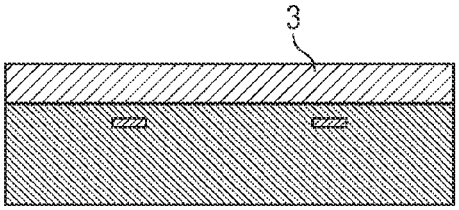

Next, as illustrated in FIG. 1B, a mold 3 is formed on the substrate 1. The material of the mold 3 is appropriately selected in relation to the materials of other members present around the mold 3. For example, when the material of the ejection orifice forming member is an inorganic material, an organic resin material or a metal material can be selected as the material of the mold 3. As the organic resin material, polyimide is preferred from the viewpoint of heat resistance. The organic resin material can be deposited by spin coating or the like. As the metal material, aluminum or an aluminum alloy is preferred from the viewpoint of removal performance. The metal material can be deposited by physical vapor deposition (PVD) such as sputtering. The thickness of the mold is not particularly limited, but may be 2 μm to 30 μm, for example.

Figure 1C:
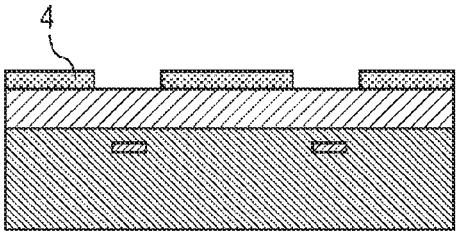
Figure 1D:
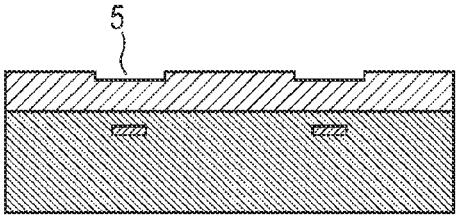

Next, as illustrated in FIGS. 1C and 1D, recessed portions 5 are formed in the mold 3 at positions corresponding to regions in which the ejection orifices are formed and in the vicinity thereof. Specifically, a mask 4 for the recessed portions is formed on the mold 3 (FIG. 1C), and the mold 3 is etched through intermediation of the mask 4 for the recessed portions, to thereby form the recessed portions 5 in the surface of the mold 3 (FIG. 1D). The mask 4 for the recessed portions can be formed with use of a photoresist. When the material of the mold 3 is an organic resin material, the recessed portions 5 can be formed by dry etching such as reactive ion etching (hereinafter referred to as "RIE") that mainly uses oxygen. Further, when the material of the mold 3 is a metal material, recessed portions 5 can be formed by RIE using a gas depending on the metal material, or wet etching using acid that can dissolve the metal material. For example, when the metal material is aluminum, chlorine can be used as an etching gas in a case of processing by RIE, and an etchant containing phosphoric acid as main component can be used in a case of processing by wet etching.

It is to be noted that the "vicinity" in "positions corresponding to regions in which the ejection orifices are formed and the vicinity thereof" refers to a range of up to at least 40 μm from each position corresponding to the region in which the ejection orifice is formed. A sectional shape of the recessed portion 5 in a plane parallel to the surface of the substrate 1 is not particularly limited, and is not required to be a circle even when the sectional shape of the ejection orifice is a circle. Further, the depth of the recessed portion 5 may be, although the depth depends on the thickness of the mold 3 and the thickness of a coating layer, 0.1 μm to 5 μm, for example. Further, the diameter of the recessed portion 5 may be, although the diameter depends on the diameter of the ejection orifice, 20 μm to 80 μm, for example. It is to be noted that the "diameter" as used herein refers to a length in a part having the largest length in the distance across in cross section.

Figure 1E:
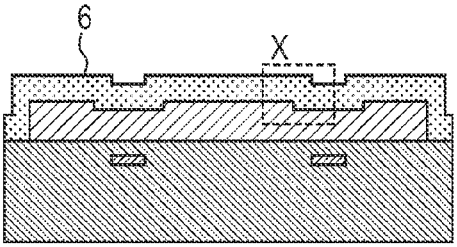

Next, as illustrated in FIG. 1E, a coating layer 6 is formed so as to cover the mold 3 having the recessed portions 5 formed therein. In the present invention, the coating layer 6 is formed by CVD. With CVD, a film can be formed in a substantially conformal manner, and hence even when the mold 3 has the recessed portions 5 formed therein, the thickness of the coating layer 6 formed thereon can be sufficiently controlled. With this, the fluctuations in thickness of the ejection orifice forming member are reduced, and hence it is possible to obtain a liquid ejection head capable of ejecting liquid from each ejection orifice in a stable amount and flying speed. Examples of the material of the coating layer 6 to be formed into the ejection orifice forming member later include a compound containing silicon and at least one element selected from the group consisting of oxygen, nitrogen, and carbon (hereinafter referred to as "silicon compound"), and a metal. Examples of the silicon compound include silicon oxide and silicon nitride. Examples of the metal include titanium, zirconium, and hafnium. Those materials may be used alone, or two or more kinds thereof may be used in combination. Among those materials, the silicon compound is preferred as the material of the coating layer 6 from the viewpoint of easiness in processing the ejection orifices when the ejection orifices are formed through the coating layer 6 in the subsequent step.

The type of CVD may be appropriately selected depending on the material of the coating layer 6. For example, when the material of the coating layer 6 is a silicon compound, the type of CVD is preferred to be plasma-enhanced CVD (PECVD) from the viewpoint of deposition rate and mass production. Further, when the material of the coating layer 6 is a metal, the type of CVD is preferred to be metal-organic CVD (MOCVD). As a method of exciting a material gas, a method that employs heat or light may be used as well as plasma excitation. The thickness of the coating layer 6 is not particularly limited, but may be 1 μm to 20 μm, for example. Further, the diameter of a recessed portion formed in the surface of the coating layer 6 so as to correspond to the recessed portion 5 is required to be larger than the diameter of the ejection orifice, and it is preferred that the diameter of the recessed portion be larger than the diameter of the ejection orifice by 5 μm to 40 μm.

Figure 3:
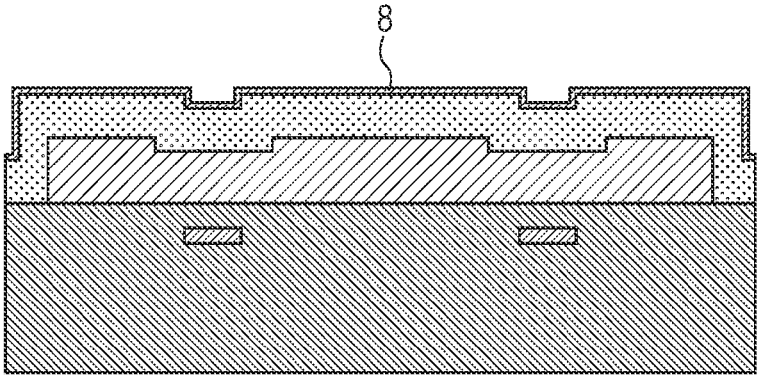
FIG. 3 is a sectional view illustrating an embodiment of the present invention in which a water repellent film is formed.

Further, as illustrated in FIG. 3, in order to improve the ejection stability, a water repellent film 8 may be further formed on the surface of the coating layer 6. The water repellent film 8 can be formed by applying, by spin coating or curtain coating, a solution obtained by diluting a fluorocarbon compound with a solvent, for example. Further, the water repellent film 8 can also be formed by exposing the coating layer 6 to an atmosphere of a fluorocarbon compound vaporized by vacuuming or heating, and drying the coating layer 6.

Figure 1F:
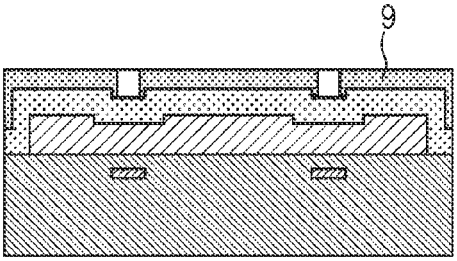

Next, as illustrated in FIG. 1F, a mask 9 for the ejection orifices is formed in order to form the ejection orifices through he coating layer 6. A general photoresist can be used as the material of the mask 9 for the ejection orifices. When a photoresist is used as the material of the mask 9 for the ejection orifices, as a method of forming the mask 9 for the ejection orifices, the photoresist can be applied by spin coating in a case where the photoresist is liquid. Further, in a case where the photoresist is a dry film resist, the mask 9 for the ejection orifices can be formed by laminating. In particular, in a case where the water repellent film 8 is formed on the surface of the coating layer 6 as illustrated in FIG. 3, liquid is less repelled through water repellent when the photoresist is a dry film resist than when the photoresist is a liquid resist, and the mask 9 for the ejection orifices can be formed more stably.

Figure 1G:
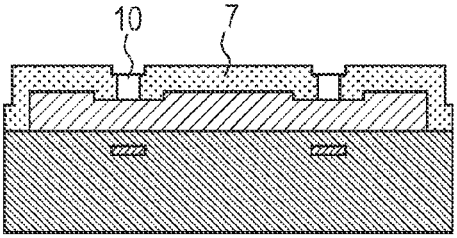

Next, as illustrated in FIG. 1G, the ejection orifices 10 are formed through the coating layer 6 by etching through intermediation of the mask 9 for the ejection orifices, to thereby obtain the ejection orifice forming member 7. As the method of etching, RIE is preferred because a perpendicular sectional shape can be easily achieved for the ejection orifice 10 in a plane perpendicular to the surface of the substrate 1. As the etching gas, when the material of the coating layer 6 is a silicon compound, a gas containing a fluorocarbon gas (such as $CF_4$, $CHF_3$, and $C_4F_8$) as a main component, and containing Ar, $O_2$, or the like as another additive gas can be used. The diameter of the ejection orifice 10 is not particularly limited, but may be 10 μm to 40 μm, for example.

Figure 1H:
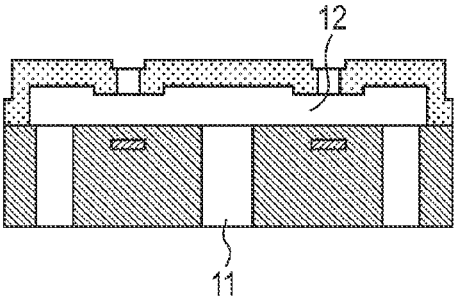

Next, as illustrated in FIG. 1H, the supply port 11 is formed in the substrate 1, and the mold 3 is removed, to thereby form the flow path 12. The supply port 11 can be formed by a Bosch process, for example. Specifically, the supply port 11 can be formed by forming a mask material (not shown), which is patterned in a region in which the supply port 11 is formed, on the back surface of the substrate 1, and alternately repeating an etching step using an $SF_6$ gas and a deposition step using a $C_4F_8$ gas. As the method of removing the mold 3, an appropriate method can be used depending on the material of the mold 3. For example, when an organic resin material is used as the material of the mold 3, the mold 3 can be removed by chemical dry etching (CDE) using an $O_2$ gas as a main component. Further, when a metal material is used as the material of the mold 3, the mold 3 can be removed by impregnating the substrate 1 into an acid or alkali solution that can dissolve the metal material. For example, when the material of the mold 3 is aluminum, the mold 3 can be removed by using an etchant containing a phosphoric acid as a main component.

In the liquid ejection head manufactured by the above-mentioned steps, the coating layer is formed in a substantially conformal manner by CVD, and hence even when the ejection orifice forming member is recessed with respect to the surface of the ejection orifice forming member in the vicinity of the ejection orifices, fluctuations in thickness of the section orifice forming member in the vicinity of the ejection orifices are small. With this, fluctuations in volume and flying speed of liquid droplets to be caused to fly from the respective ejection orifices are reduced, and thus a high-quality liquid ejection head can be obtained.

Figure 4A:
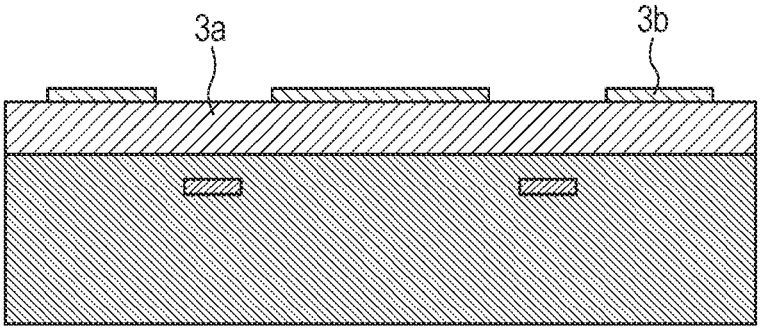
FIGS. 4A and 4B are sectional views illustrating an embodiment of the present invention in which a first mold and a second mold are formed.
Figure 4B:
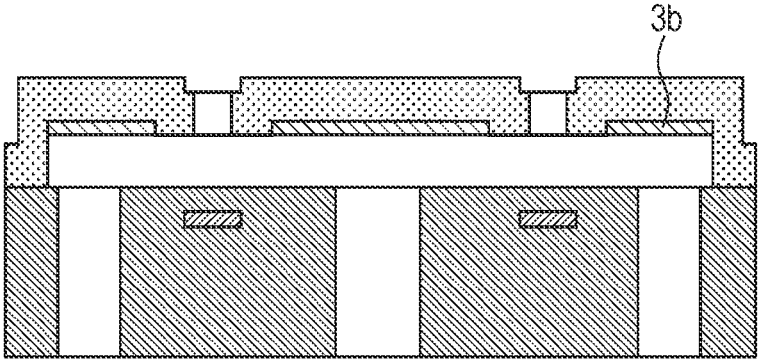

Further, as another embodiment of the present invention, FIGS. 4A and 4B illustrate another method of forming the recessed portions 5 in the mold 3. According to the method, after a first mold 3*a* is formed on the substrate 1, a second mold 3*b* is formed on the first mold at positions other than the positions corresponding to the regions where the ejection orifices are formed and the vicinity thereof, to thereby form the recessed portions 5 (FIG. 4A). In the method, the same material as that of the first mold 3*a* can be used as the material of the second mold 3*b*, but it is preferred that a material different from that of the first mold 3*a* be used as the material of the second mold 3*b*. For example, an organic resin material can be used as the material of the first mold 3*a*, and a metal material can be used as the material of the second mold 3*b*. The first mold 3*a* basically determines the height of the flow path, and hence it is preferred that an organic resin material be used as the material of the first mold 3*a*, which can be applied by spin coating capable of easily controlling a film thickness. As the organic resin material, polyimide is preferred. Further, it is preferred that, when the second mold 3*b* is patterned, the first mold 3*a* present as an underlayer not be damaged, and further from the viewpoint of heat resistance, a metal material is preferred as the material of the second mold 3*b*. As the metal material, from the viewpoint of easiness in processing, aluminum or an aluminum alloy is preferred. The metal material is patterned by forming a mask with use of a general photoresist, and then carrying out etching through intermediation of the mask, for example. Examples of the etching include dry etching and wet etching, and etching suitable for the metal material can be appropriately selected. For example, when the metal material is aluminum or an aluminum alloy, the metal material may be patterned by RIE using a $Cl_2$ gas as a main component, or etching using an acid or alkali solution.

Further, when different materials are used between the first mold 3*a* and the second mold 3*b*, as illustrated in FIG. 4B, it is preferred that the second mold 3*b* be caused to remain in the flow path as a structure. By causing the second mold 3*b* to remain, the thickness of the ejection orifice forming member is increased, and the mechanical strength of the ejection orifice forming member can be increased. When the second mold 3*b* is caused to remain in the flow path, it is preferred that a chemically stable material that does not dissolve in liquid such as ink to be ejected be used as the material of the second mold 3*b*, and, for example, gold, a silicon compound, or the like is preferred. When gold is used as the material of the second mold 3*b*, the second mold 3*b* can be formed by sputtering, ion beam deposition, vacuum heating deposition, or the like. Further, with use of an appropriate photoresist as a mask, patterning can be performed with use of iodine-potassium iodide. When a silicon compound is used as the material of the second mold 3*b*, the second mold 3*b* can be formed by PECVD. Further, with use of an appropriate photoresist as a mask, dry etching can be performed with use of a gas containing a fluorocarbon gas (such as $CF_4$, $CHF_3$, and $C_4F_8$) as a main component, and containing Ar, $O_2$, or the like as another additive gas. Further, when the silicon compound is silicon oxide, wet etching can be performed with use of buffered hydrofluoric acid.

Figure 5A:
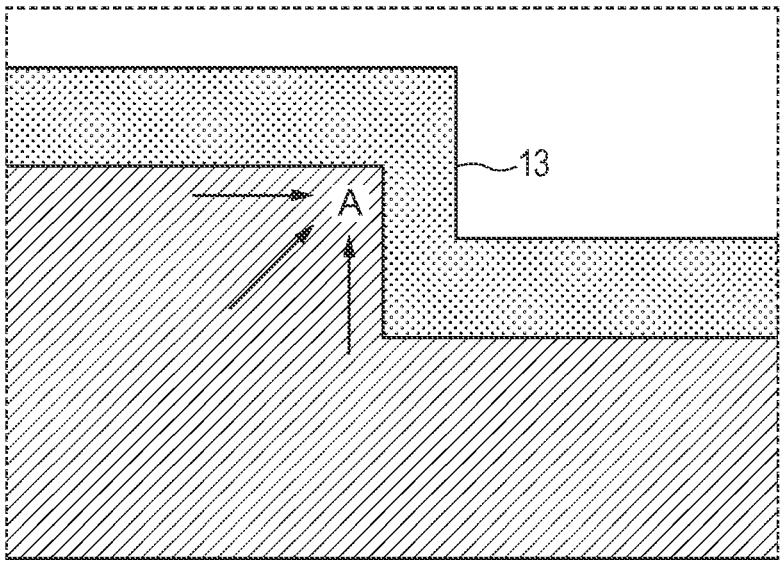
FIGS. 5A and 5B are enlarged views of a part X surrounded by broken lines illustrated in FIG. 1E.
Figure 5B:
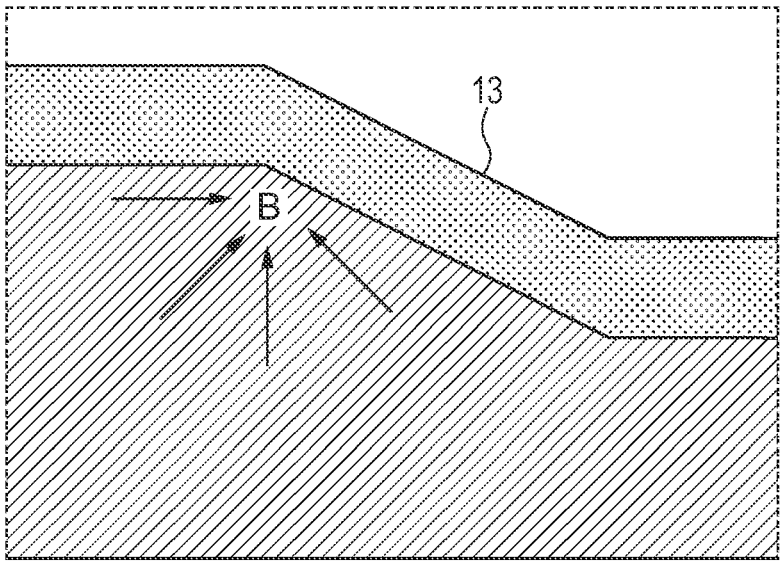

Further, another embodiment of the present invention is described with reference to FIGS. 5A and 5B. FIGS. 5A and 5B are enlarged views of a part X surrounded by broken lines illustrated in FIG. 1E. FIG. 5A illustrates a case where a sectional profile of a step 13 of the mold and the coating layer in the vicinity of the recessed portion is perpendicular, and FIG. 5B illustrates a case where the sectional profile of the step 13 is substantially tapered so that the diameter of the recessed portion increases from the substrate side toward the surface of the mold. From the viewpoint of removal performance of the mold and the strength of the ejection orifice forming member, it is preferred that a sectional shape of the recessed portion be a substantially taper shape. Regarding the removal performance of the mold, when the sectional profile of the step 13 is perpendicular, during removal of the mold, the supply and discharge performance of a gas or liquid for etching is low because the angle of the step 13 is close to an acute angle (part A of FIG. 5A). Thus, an etching residue is often generated. On the other hand, when the sectional profile of the step 13 is substantially tapered, the supply and discharge performance of a gas or liquid for etching is improved because the angle of the step 13 is large (part of FIG. 5B). Thus, the etching residue is reduced. Further, regarding the strength of the ejection orifice forming member, when the angle of the step 13 is close to an acute angle, in a case where an external force is applied to the surface of the ejection orifice forming member of the liquid ejection head due to a conveyance error of a recording medium such as paper, the external force is liable to concentrate thereon. On the other hand, when the angle of the step 13 is large, the concentration of the external force is reduced, and the ejection orifice forming member is prevented from being damaged. It is to be noted that this effect is similarly obtained also in the embodiment in which the second mold 3*b* is caused to remain as illustrated in FIG. 4B. The angle of the substantially taper shape is not particularly limited, but it is preferred that the angle represented in the part B in FIG. 5B be 100° to 140°. It is to be noted that the substantially taper shape refers to a shape that exhibits a taper shape as a whole even when there is a part that is out of the taper shape.

A method of forming the recessed portion whose sectional shape is substantially tapered can include, in a case where RIE is used when the recessed portion is formed in the flat mold or when the second mold is patterned, setting the pattern sectional profile of the mask to a taper shape. As a method of setting the pattern sectional profile of the mask to a taper shape, there are a method of shifting the imaging position in exposure and a method of carrying out heat treatment after patterning and leaving the pattern. Further, even by employing an isotropic method such as CDE and wet etching as the etching method, the recessed portion whose sectional shape is substantially tapered can be formed.

EXAMPLES

Now, the method of manufacturing a liquid ejection head according to the present invention is described in more detail by means of examples. It is to be noted that the present invention is not limited to those examples.

Example 1

First, as illustrated in FIG. 1A, the substrate 1 having a thickness of 300 μm was prepared, in which the energy generating elements 2 and wiring (not shown) for driving the energy generating elements 2 were disposed on one side of a monocrystalline silicon substrate whose ingot drawing direction was <100>. Next, as illustrated in FIG. 1B, the mold 3 was formed on the substrate 1. As the material of the mold 3, polyimide (product name: PI2611, produced by Hitachi Chemical DuPont Microsystems, Ltd.) was used. The material was applied on the substrate 1 by spin coating, and baked to vaporize the solvent. Then, the material was put inside an oven set to 400° C. for 1 hour to be subjected to dehydration and condensation. With this, the mold 3 was formed. The thickness of the mold 3 was 7 μm.

Next, as illustrated in FIG. 1C, in order to form the recessed portions at the positions corresponding to the regions in which the ejection orifices are formed and in the vicinity thereof, the mask 4 for the recessed portions was formed on the mold 3. The mask 4 for the recessed portions was formed by applying a positive photoresist (product name: ZR8800, produced by TOKYO OHKA KOGYO CO., LTD.) on the mold 3, and patterning the positive photoresist into a desired pattern. Next, as illustrated in FIG. 1D, at positions corresponding to regions in which the ejection orifices are formed and in the vicinity thereof, the recessed portions 5 were formed by RIE with use of the mask 4 for the recessed portions as a mask. A parallel plate RIE apparatus was used as an etching device, and the mold 3 was etched by 2 μm with a gas containing an $O_2$ gas as a main component. After the etching, the substrate 1 was impregnated into a resist remover (product name: MICROPOSIT Remover 1112A, produced by Rohm and Haas Electronic Materials Company) to remove the mask 4 for the recessed portions, and then the substrate was sufficiently washed and dried. It is to be noted that the sectional shape of the recessed portion 5 thus formed was a shape having a side perpendicular to the substrate.

Next, as illustrated in FIG. 1E, the coating layer 6 was formed of silicon oxide with use of PECVD. The thickness of the coating layer 6 was 3 μm. At this time, the film was deposited in a substantially conformal manner, and the thickness of the coating layer 6 was stable even in the part of the recessed portion 5 of the mold 3. Next, as illustrated in FIG. 1F, in order to form the ejection orifices, the mask 9 for the ejection orifices was formed on the coating layer 6. As the material of the mask 9 for the ejection orifices, a dry film resist (product name: ORDYL AR320, produced by TOKYO OHKA KOGYO CO., LTD.) was used. The mask 9 for the ejection orifices was formed by forming a film by laminating with use of the material, and exposing and developing the film, to thereby pattern the positions at which the ejection orifices are formed.

Next, as illustrated in FIG. 1G, the ejection orifices 10 were formed through the coating layer 6 to obtain the ejection orifice forming member 7. The ejection orifices 10 were formed with use of a parallel plate RIE device and the mask 9 for the ejection orifices as a mask, by etching the coating layer 6 with a mixed gas of $CF_4$, $CHF_3$, Ar, and $O_2$. After that, the mask 9 for the ejection orifice was removed with use of a remover (product name: STRIPPER 104, produced by TOKYO OHKA KOGYO CO., LTD.). Next, a mask for forming the supply port 11 was formed on the back surface of the substrate 1, and the supply port 11 was formed by a Bosch process from the back surface of the substrate 1 toward the front surface of the substrate 1. After that, the mask was removed.

Finally, as illustrated in FIG. 1H, the mold 3 was removed by CDE using an $O_2$ gas as a main component to complete the liquid ejection head. When the liquid ejection head manufactured as described above was used to be measured for its volume and flying speed of liquid ejecting from each ejection orifice, it was confirmed that fluctuations in each ejection orifice were small.

Example 2

A liquid ejection head was manufactured similarly to that in Example 1 with the exception that silicon carbide nitride (SiCN) was used as the material of the coating layer 6 illustrated in FIG. 1E. When the liquid ejection head was measured its volume and flying speed of liquid ejecting from each ejection orifice, it was confirmed that fluctuations in each ejection orifice were small.

Example 3

As illustrated in FIG. 4A, the first mold 3*a* was formed on the substrate 1 similarly to Example 1. As the material of the first mold 3*a*, polyimide (product name: PI2611, produced by Hitachi Chemical DuPont MicroSystems, Ltd.) was used. The material was applied on the substrate 1 by spin coating, and baked to vaporize the solvent. Then, the material was out inside an oven set to 400° C. for 1 hour to be subjected to dehydration and condensation. With this, the first mold 3*a* was formed. The thickness of the first mold 3*a* was 5 μm.

Subsequently, as illustrated in FIG. 4A, the second mold 3*b* was formed on the first mold 3*a* at positions other than the positions corresponding to the regions in which the ejection orifices are formed and the vicinity thereof. Gold was used for the material of the second mold 3*b*. The second mold 3*b* was formed by sputtering, and the thickness of the second mold 3*b* was 2 μm. As a mask for patterning gold, a positive resist (product name: iP5700, produced by TOKYO OHKA KOGYO CO., LTD.) was used. As the etchant, an iodine-potassium iodide solution (product name: AURAM, produced by KANTO CHEMICAL CO., INC.) was used.

The steps subsequent to the forming of the coating layer 6 were performed to the 2-stage molds formed by the above-mentioned method similarly to Example 1, to thereby manufacture the liquid ejection head. It is to be noted that the first mold 3*a* was removed in the step of removing the mold, but the second mold 3*b* was not etched by an $O_2$ gas. Therefore, as illustrated in FIG. 4B, the second mold 3*b* remained inside the flow path 12.

In the liquid ejection head manufactured as described above, the thickness of the ejection orifice forming member was able to be increased, and the mechanical strength of the ejection orifice forming member was able to be increased. In addition, when the volume and flying speed of the liquid ejecting from each ejection orifice were measured, it was confirmed that fluctuations in each ejection orifice were small.

The liquid ejection head manufactured by the method according to the present invention can be suitably used for a liquid ejection head of an ink jet printer.

According to one embodiment of the present invention, it is possible to provide the liquid ejection head capable of ejecting liquid from each ejection orifice in a stable amount and flying speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-119820, filed Jun. 6, 2013, which is hereby incorporated by reference herein in its entirety.

What is claimed is:

1. A method of manufacturing a liquid ejection head including: a substrate having energy generating elements disposed thereon; and an ejection orifice forming member having ejection orifices, the substrate and the ejection orifice forming member forming a flow path therebetween, the method comprising:

forming, on the substrate, a mold having a recessed portion at a surface of the mold that faces away from the substrate;

forming a coating layer by chemical vapor deposition so as to cover the mold; and forming an ejecting orifice inside a recessed portion of the coating layer formed on the recessed portion of the mold to obtain the ejection orifice forming member.

2. The method according to claim 1, wherein the ejection orifice forming member comprises a compound containing silicon and at least one element selected from the group consisting of oxygen, nitrogen, and carbon.

3. The method according to claim 1, wherein the forming of the mold comprises forming the recessed portion by dry etching.

4. The method according to claim 1, wherein the forming of the mold comprises:

forming a first mold on the substrate; and forming a second mold on the first mold at a position other than a position corresponding to a region in which each of the ejection orifices is to be formed.

5. The method according to claim 4, further comprising removing the first mold and causing the second mold to remain, thereby forming the flow path.

6. The method according to claim 1, further comprising removing the mold to form the flow path.

7. The method according to claim 1, wherein the recessed portion has a sectional shape that is a substantially taper shape in which a diameter of the recessed portion increases in a direction toward the surface of the mold that faces away from the substrate.

8. The method according to claim 1, wherein the forming of the ejection orifice comprises forming the ejection orifice by reactive ion etching.

* * * * *